US005901674A

United States Patent [19]

Fujiwaki

[11] Patent Number: 5,901,674

[45] Date of Patent: May 11, 1999

[54] VARIABLE VALVE TIMING DEVICE

[75] Inventor: Kenji Fujiwaki, Aichi-pref., Japan

[73] Assignee: Aisin Seiki Kabushiki Kaisha, Aichi-pref., Japan

[21] Appl. No.: 09/016,647

[22] Filed: Jan. 30, 1998

[30] Foreign Application Priority Data

Feb. 6, 1997 [JP] Japan ..... 9-024144

[51] Int. Cl.[6] ..... F01L 1/344; F01L 13/00

[52] U.S. Cl. ..... 123/90.17; 123/90.31; 74/568 R; 464/2; 464/160

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,205,249 | 4/1993 | Markley et al. | 123/90.17 |
| 5,207,192 | 5/1993 | Smith | 123/90.17 |
| 5,450,825 | 9/1995 | Geyer et al. | 123/90.17 |
| 5,520,145 | 5/1996 | Nagai et al. | 123/90.17 |

FOREIGN PATENT DOCUMENTS

| | | | |
|---|---|---|---|
| A-799976 | 10/1997 | European Pat. Off. . | |
| 1-92504 | 4/1989 | Japan . | |
| 2-50105 | 4/1990 | Japan . | |
| 8-121122 | 5/1996 | Japan . | |
| 2302391 | 1/1997 | United Kingdom | 123/90.17 |
| A2314402 | 12/1997 | United Kingdom . | |

*Primary Examiner*—Weilun Lo
*Attorney, Agent, or Firm*—Hazel & Thomas, P.C.

[57] ABSTRACT

A variable valve timing device includes a rotation shaft and a rotation transmitting member rotatably mounted thereon. The device operates between a locked condition and an unlocked condition, wherein a locking pin is in and out of a receiving bore formed in the rotation shaft, respectively. For transferring the locking condition to the unlocking condition, oil is supplied to a bottom of the receiving bore via an independent fluid passage.

3 Claims, 7 Drawing Sheets

VARIABLE VALVE TIMING DEVICE

BACKGROUND OF THE INVENTION

The present invention relates to a variable valve timing device for controlling the opening and closing of intake or exhaust valves of an internal combustion engine.

One such conventional variable valve timing device is disclosed in Japanese Utility Model Laid-open Print No. 2-50105 which was published in 1990 without examination. This variable valve timing device includes a rotational shaft for opening and closing a valve, a rotational transmitting member rotatably mounted on the rotational shaft, a vane connected to the rotational shaft, an operating chamber defined between the rotational shaft and the rotational transmitting member and divided into an advancing angle space and a delaying angle space by the vane extended into the operating chamber, a first passage in fluid communication with the advance angle space for supplying and draining a fluid therein and therefrom, respectively, a second passage in fluid communication with the delay angle space for supplying and draining the fluid therein and therefrom, respectively, a retracting bore formed in the rotational transmitting member; a spring-biased locking pin fitted in the retracting bore, a receiving bore formed in the rotational shaft and having a bottom expected to receive the locking valve when the receiving bore is brought into alignment with the retracting bore due to in-phase relationship between the rotational shaft and the rotational transmitting member; and a third fluid passage for supplying an oil to the receiving bore, wherein the third fluid passage is in continual fluid connection to the first fluid passage.

In the conventional variable valve timing device, due to the continual fluid communication between the first fluid passage and the third fluid passage, when an oil supply to the advancing angle space from the first fluid passage is established concurrently with an oil drain from the delaying angle space into the second fluid passage, the receiving bore is supplied with the oil from the first fluid passage via the third fluid passage. Due to the resulting oil supply, the locking pin is retracted into the retracting bore, and the head portion of the locking pin disengages from the receiving bore. Thus, the locking condition between the rotational shaft and rotational transmitting member that was established by the locking pin is released with the result that the rotational shaft rotates in an advancing angle direction relative to the rotational transmitting member.

If an oil supply to the delaying angle space from the second fluid passage and an oil drain from the advancing angle space into the first fluid passage are established concurrently, contrary to the above, the rotational shaft rotates toward a delaying angle position relative to the rotational transmitting member. In addition, an oil drain is established from the receiving bore into the third and the first fluid passages which results in no oil pressure being applied to the spring-biased locking pin and the locking pin being brought into engagement with the receiving bore when the inner rotor and the outer rotor are in-phase with each other, such that the rotational of the inner rotor relative to the outer rotor is prevented.

However, in the foregoing or conventional variable valve timing device, whenever the device is in operation, the locking pin is brought into engagement with or disengagement from the receiving bore. In light of such repetitive locking and unlocking movement of the locking pin, to prevent damage to the locking pin, the locking pin has to be made of a relatively high cost material.

In addition, as a result of the continual fluid communication between the first fluid passage and the third fluid passage, a relatively complex fluid pressure control system is required for retracting the locking pin from the receiving bore that is capable of positioning the receiving bore to receive therein the locking pin intermediately between the most advancing angle position and the most delaying angle position.

SUMMARY OF THE INVENTION

It is, therefore, one of the objects of the present invention to provide a variable valve timing device that is free from the foregoing drawbacks.

In order to attain the above objects, a variable valve timing device according to the present invention includes: a rotational shaft for opening and closing a valve, a rotational transmitting member rotatably mounted on the rotational shaft, a vane provided to one of the rotational shaft and the rotational transmitting member, an operating chamber defined between the rotational shaft and the rotational transmitting member and divided into an advancing angle space and a delaying angle space by the vane extending into the operating chamber, a first passage defined to be in fluid communication with the advance angle space for supplying and discharging a fluid therein and therefrom, respectively, a second passage defined to be in fluid communication with the delay angle space for supplying and discharging the fluid therein and therefrom, respectively, regulating means for regulating relative rotational between the rotational shaft and the rotational transmitting member, and a third fluid passage provided independently of the first and the second fluid passages for supplying an oil to the regulating means.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE INVENTION

Figure 1:
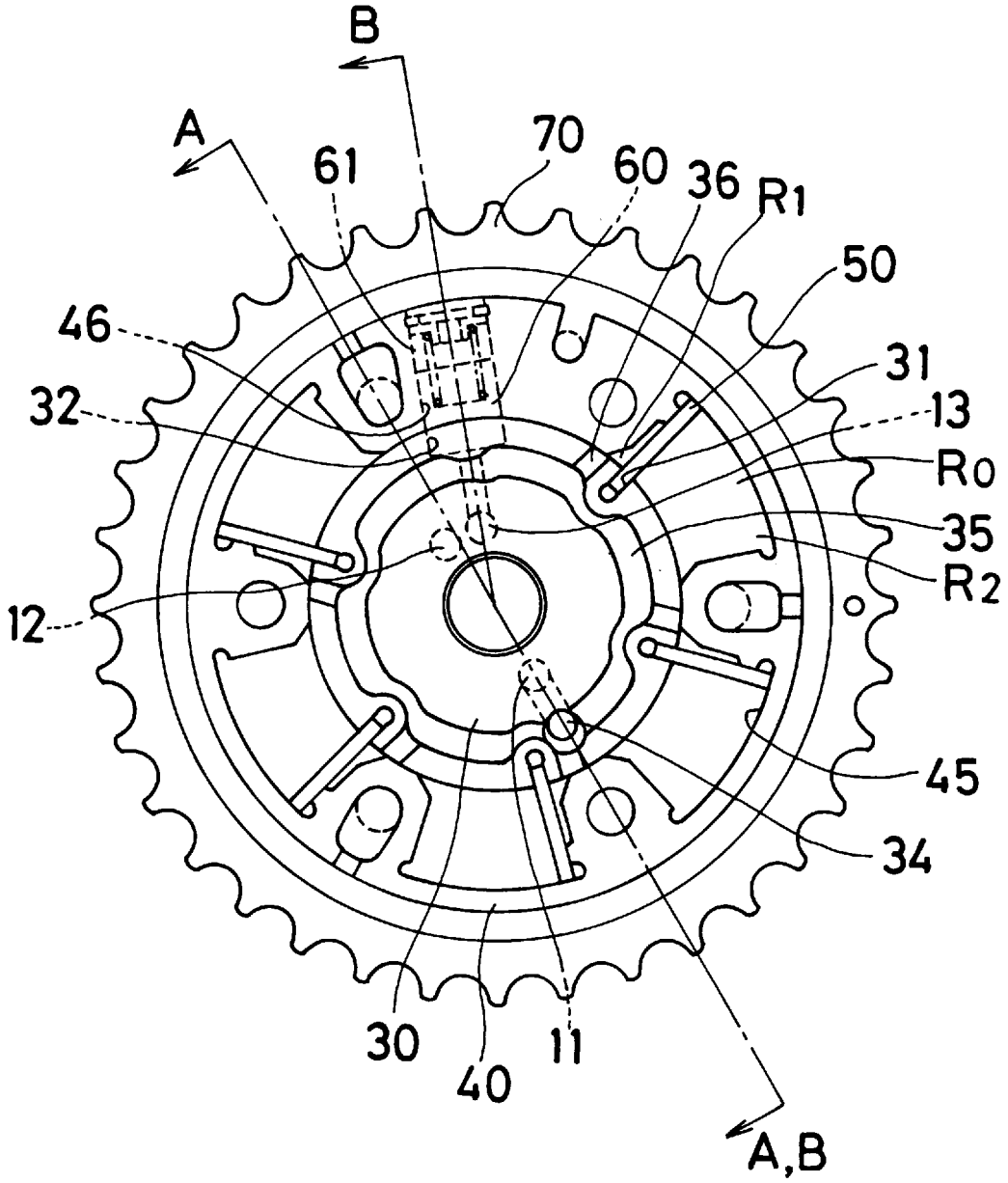
FIG. 1 is a cross-sectional view of a variable valve timing device according to an embodiment of the present invention.

Preferred embodiments of the present invention will be described hereinafter in detail with reference to the accompanying drawings.

Referring first to FIGS. 1 through 4 wherein a first embodiment of a variable valve timing device in accordance with the present invention is illustrated, the variable valve timing device includes a cam shaft 10, an inner rotor 30, and a plurality of angularly spaced vanes 50 which constitute a rotational shaft for opening and closing valves. The variable valve timing device also includes an outer rotor 40 mounted on the cam shaft 10 so as to be rotated relative thereto through a limited angle a locking pin 60, a timing pulley 70, and on which constitute a rotational transmitting member. A cylinder head 81 of an internal combustion engine (not shown) holds the cam shaft 10 rotatably via a bearing 80 which is fixed to the cylinder head 81, whereby the variable valve timing device is rotatably mounted to the cylinder head 81. As is well known, the timing pulley 70 is set to be rotated in the clockwise direction in FIG. 1 by being applied with a force from a crank pulley via a timing belt (neither is shown).

The cam shaft 10 has a well-known cam 200 which serves for opening and closing an intake valve 210 (or an exhaust valve which is not depicted) and within the cam shaft 10 there are formed an advancing angle passage 11, a delay passage 12, and a pilot passage 13 which are extended along an axial direction of the cam shaft 10. The advancing angle passage 11 is connected to a port 101 of a first change-over valve 100 via an annular passage 91 which is formed in an inner surface of the bearing 80 and a connecting passage 92. The delay passage 12 is connected to a port 102 of the first change-over valve 100 via an annular passage 93 which is formed in the inner surface of the bearing 80 and a connecting passage 94. The pilot passage 13 is connected to a connecting port 111 of a second change-over valve 110.

Figure 2:
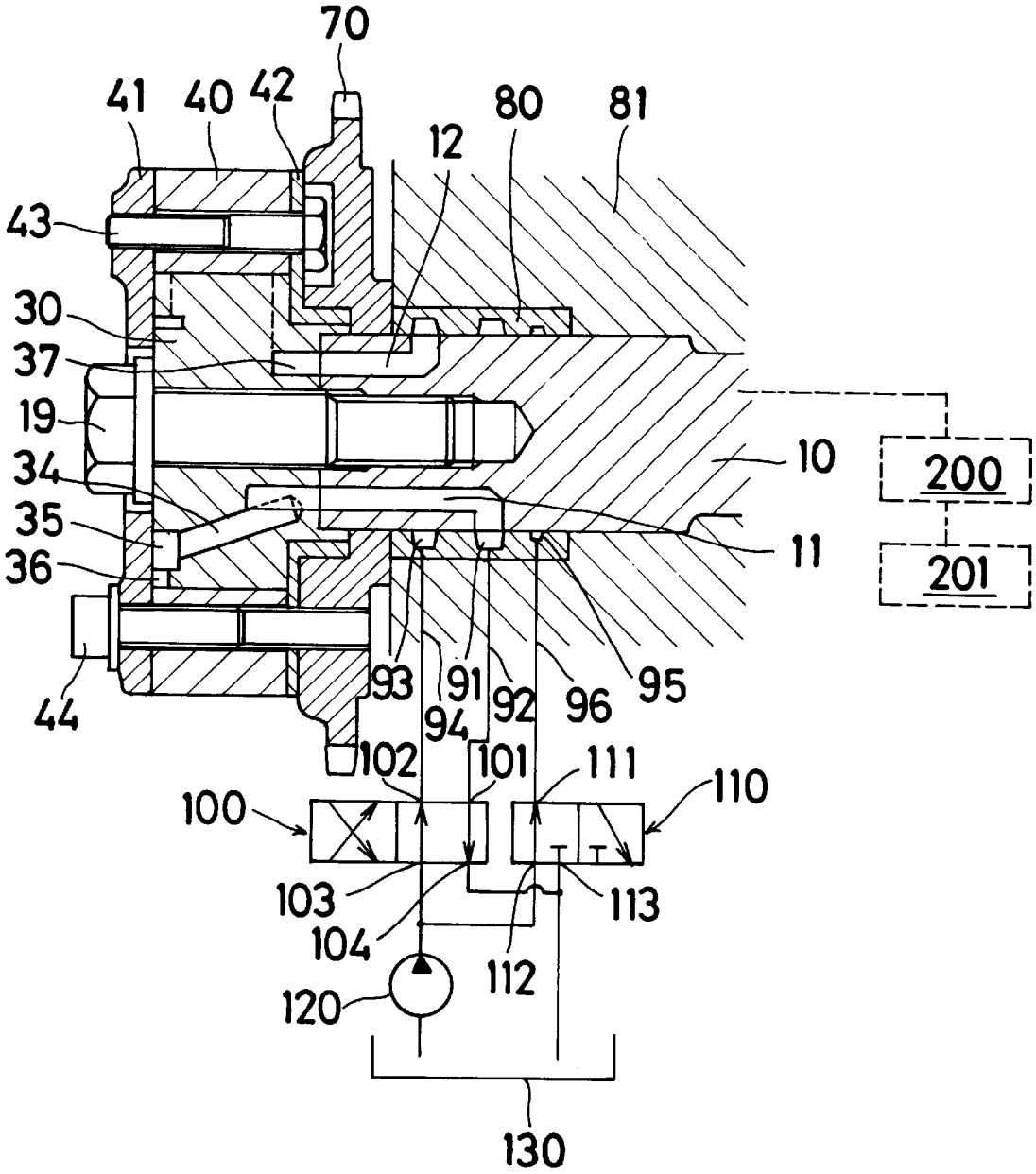
FIG. 2 is a cross-sectional view taken along line A—A in FIG. 1.
Figure 3:
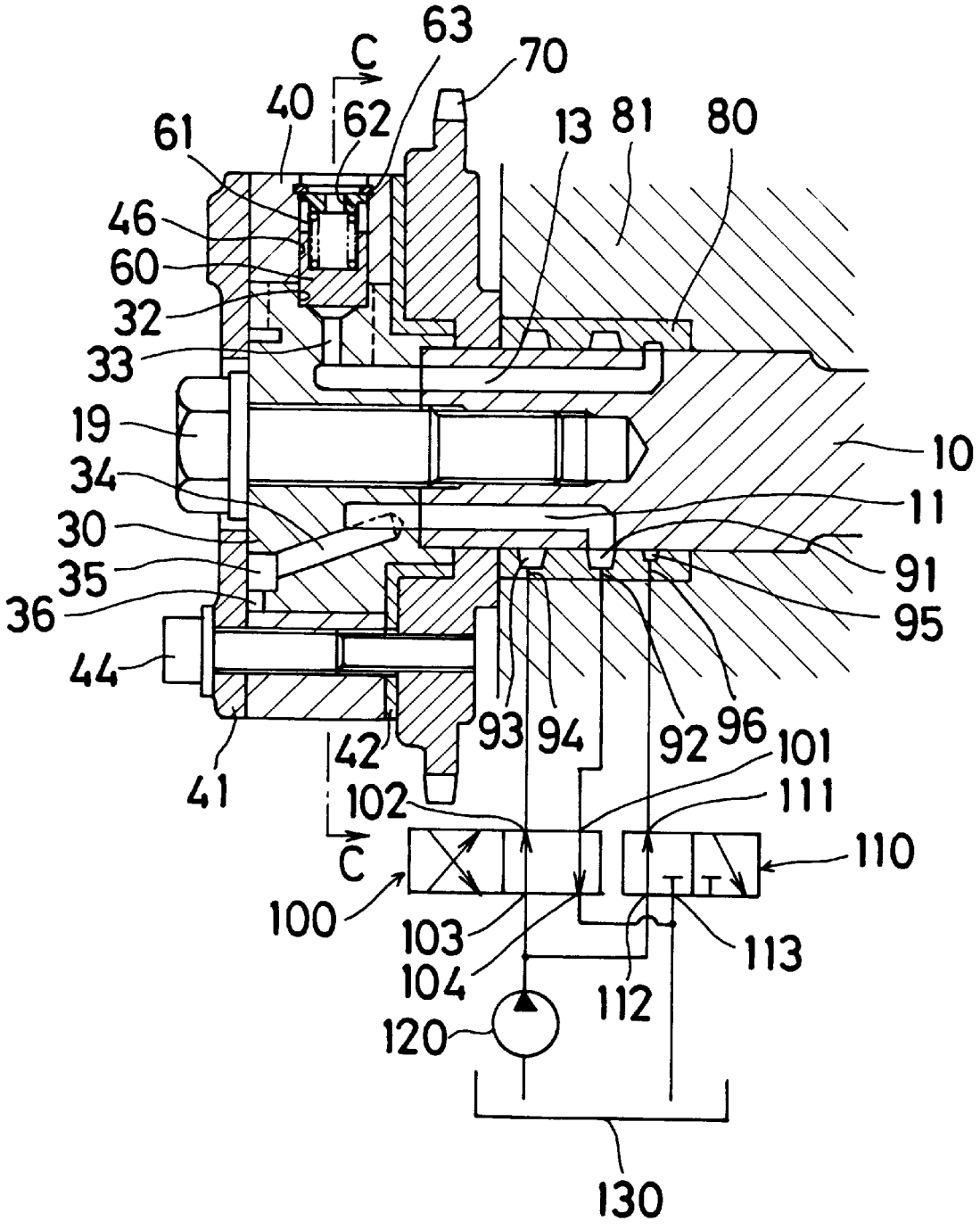
FIG. 3 is a cross-sectional view taken along line B—B in FIG. 1.
Figure 4:
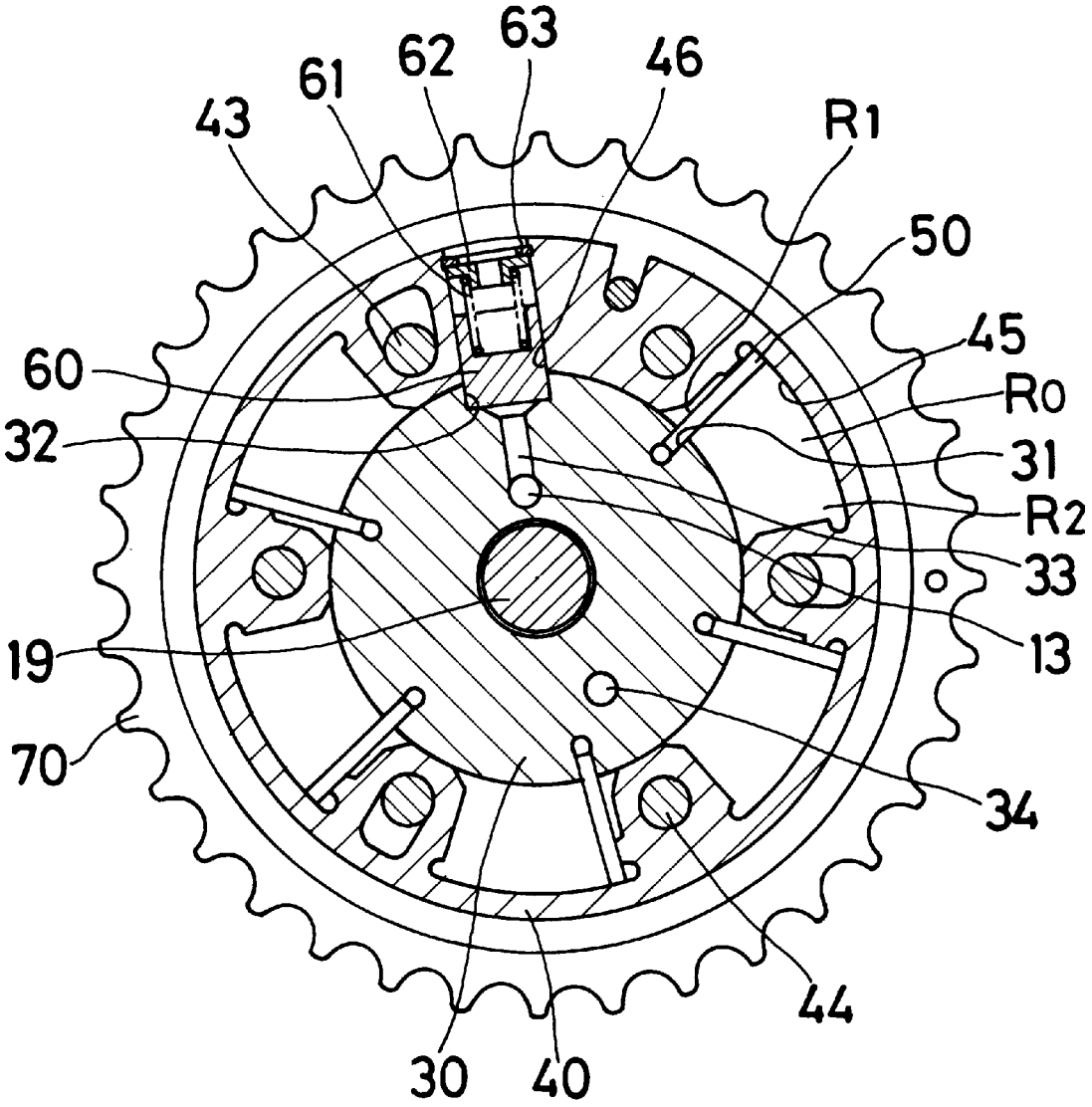
FIG. 4 is a cross-sectional view taken along line D—D in FIG. 3.

The first change-over valve 100 is under the control of a controller (not shown) which is in the form of a microprocessor. The first change-over valve 100 is expected to operate such that while the variable timing device is in an advancing angle position as shown in FIGS. 2 and 3, the connecting port 102 connected to a supply port 103 is connected to an oil pump 120 driven by the internal combustion engine, and the connecting port 101 is connected to a drain port 104 connected to a reservoir 130. When the variable valve timing device takes a delaying angle condition, the first change-over valve 100 is switched so as to connect the supply port 103 and the connecting port 102 to the connecting port 101 and the draining port 104, respectively. Thus, in the advancing angle condition, an oil supply is established between the oil pump 120 and the advancing angle passage 11 and an oil drain is established between the delaying angle passage 12 and the reservoir 130. On the other hand, in the delaying angle condition, the oil is supplied from the oil pump 120 to the delaying angle passage 12, and the oil is drained from the advancing angle passage 11 to the reservoir 130.

The second change-over valve 110 is under the control of the controller similar to the first change-over valve 100 and is expected to take a supply condition as shown in FIGS. 2 and 3 and a drain condition. Under the supply condition, in the second change-over valve 110, the connecting port 111 is connected to a supply port 112 that is connected to the oil pump 120, and a drain port 113 is isolated from the reservoir 130. On the other hand, under the drain condition, in the second change-over valve 110, the connecting port 111 is isolated from the supplying port 112 and is connected to the drain port 113. Thus, under the supply and the drain conditions, the oil is supplied to and is drained from, respectively, pilot passage 13.

The inner rotor 30 is fixedly secured to a left end portion of the cam shaft 10 by means of a bolt 19 and is provided with grooves 31 in the radial direction so as receive therein the vanes 50, respectively. The inner rotor 30 includes a receiving bore 32 which receives a portion of a head portion of a locking pin 60 under the condition shown in FIGS. 1 through 4 in which the rotational shaft having the cam shaft 10 and the inner rotor 30, and the rotating transmitting member including the timing pulley 70 are in phase coincident with each other. The inner rotor 30 further has a connecting passage 33 for establishing fluid communication between a bottom of the receiving bore 32 and the pilot passage 13, a connecting passage 34 for establishing fluid communication between the advancing angle passage 11 and each of advancing angle chambers R1 which will be detailed later, an annular passage 35 (cf. FIG. 1), a radial passage 36 (cf. FIG. 1), and a connecting passage 37 (cf. FIG. 2) for establishing fluid communication between the delaying angle passage 12 and each of delaying angle chambers R2, which will also be detailed later. It is to be noted that each vane 50 is urged outwardly by a spring (not shown) accommodated in the corresponding groove 31 so as to be located between its bottom and each vane 50.

The outer rotor 40 is mounted on the outer periphery of the inner rotor 30 so as to be rotated relative thereto within a range. There are fixedly secured plates 41 and 42 on both sides of the outer rotor 40, respectively, by means of a bolt 43. The timing pulley 70 which is adjacent to the plate 42 is secured thereto by means of a bolt 44 which passes in a screw-like manner through the plate 41, the inner rotor 40, the plate 42 and the timing pulley 70. Thus, the outer rotor 40, the plate 41, the plate 42 and the timing pulley 70 are constructed into one unit.

The outer rotor 40 is provided therein with a retracting bore 46 and five concave portions 45 which are arranged in a circumferential direction. The vane 50 extends into the concave portion 45 which defines therein an operating chamber R0, resulting in that the operating chamber R0 being divided into the advancing angle chamber R1 and the delaying angle chamber R2 which are located at the counter-clockwise side and the clockwise side thereof, respectively. In the retracting bore 46, the locking pin 60 and a spring 61 which urges the locking pin 60 toward the inner rotor 30 are accommodated in the concave portion 45. The retracting bore 46 is concentric with a diameter of a cross-section of the inner rotor 30.

The locking pin 60 accommodated fully in the retracting bore 46 is movable in the circumferential direction of the outer surface of the inner rotor 30 when the outer rotor 40 rotates relative thereto. The spring 60 is a compressed spring which is disposed between the locking pin 60 and a retainer 62 secured to an outer side of the retracting bore 46. Removal or extraction of the retainer 62 is prevented by a clip 63 which is secured to the outer rotor 40.

Figure 5:
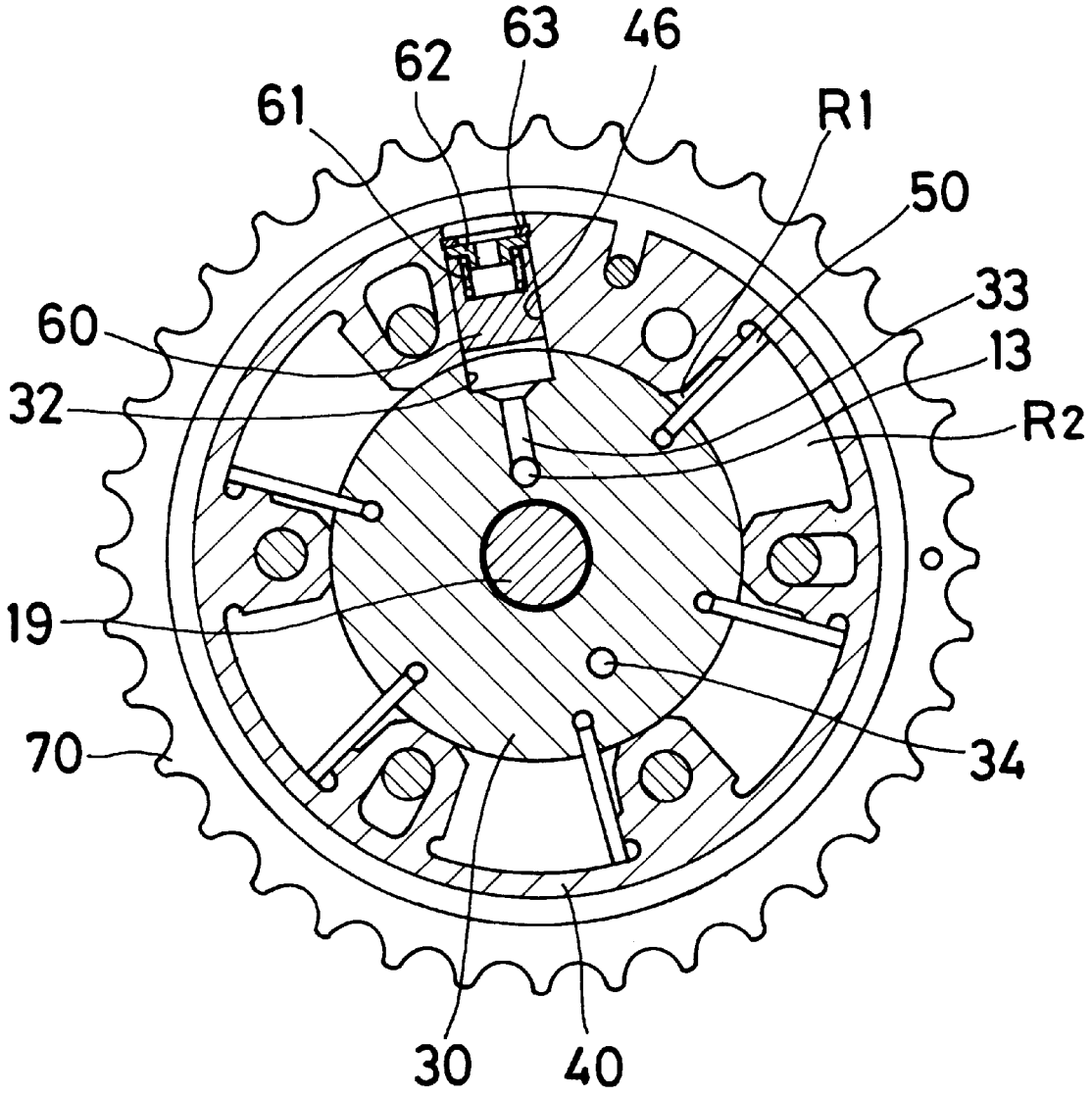
FIG. 5 is a view similar to FIG. 4 but is different in that, in the former, a locking pin is in a retracted condition.

The variable valve timing device as constructed above in which the locking pin 60 is fitted in the receiving bore 32 while the volume of the advancing angle chamber R1 is being minimized at the most delaying angle condition operates as follows. When the oil under pressure is supplied to the receiving bore 32 from the oil pump 120 via the second change-over valve 10 and the pilot passage 13, as indicated in FIG. 5, the resultant oil pressure urges the locking pin 60 outwardly against the urging force of the spring 61, which results in that the locking pin 60 being brought into engagement with the retracting bore 46 after being fully ejected from the receiving bore 32. Thus, the resultant released or an unlocked condition of the inner rotor 30 with the outer rotor 40 by the locking pin 60 allows clockwise movement of the rotational side members such as the cam shaft 10, the inner rotor 30 and the vanes 50 relative to the rotational transmitting members such as the outer rotor 40 and the timing pulley 70.

Figure 6:
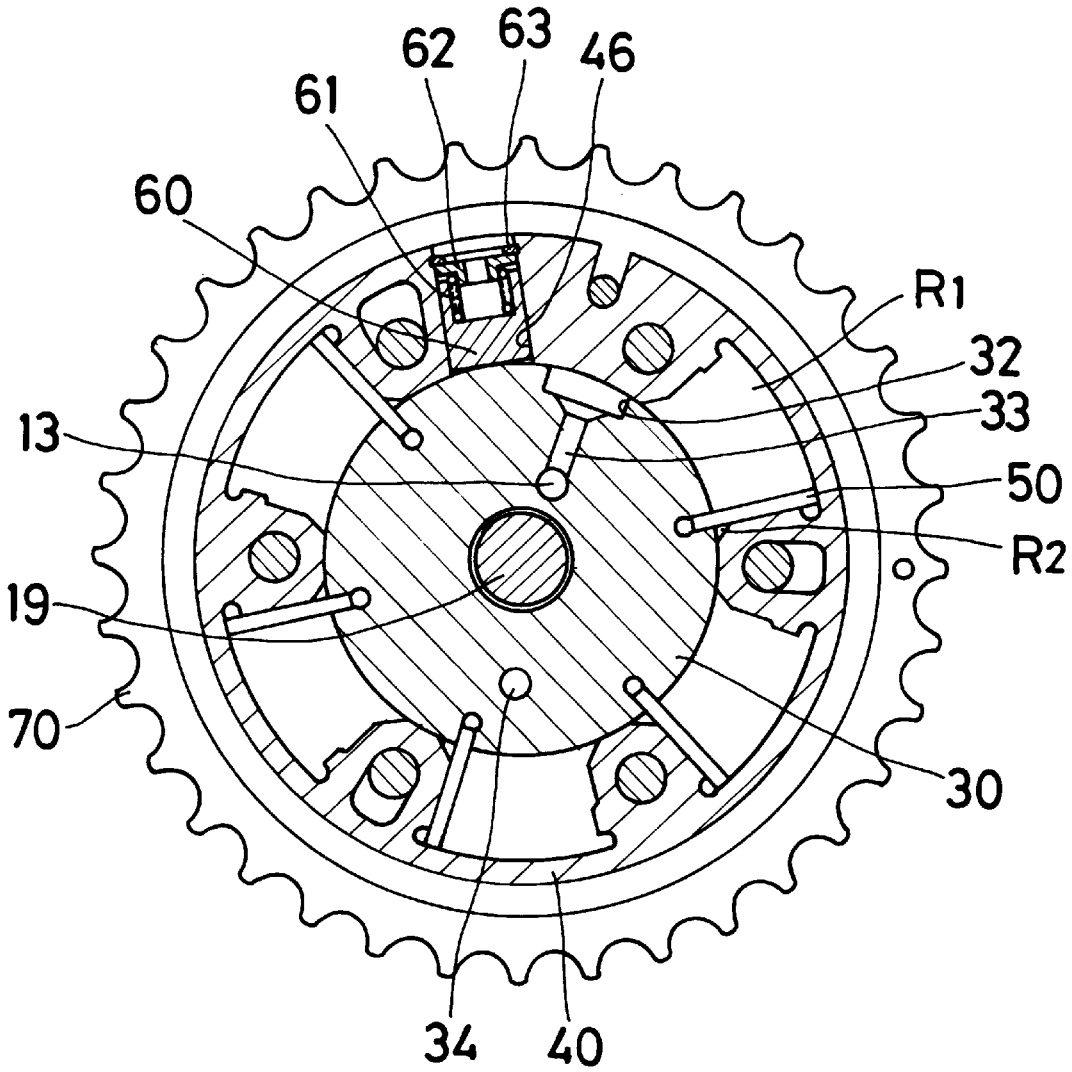
FIG. 6 is a view similar to FIG. 5 but is different in that, in the former, a driven member is rotated through an angle relative to a rotational transmitting member in the clockwise direction.

If the first change-over valve 100 is switched to the advancing angle position while the variable valve timing device is in the most delaying angle condition as shown in FIG. 5 when the volume of the advancing angle chamber R1 is at a minimum and the locking pin 60 is in the released or unlocked position, and the oil is supplied from the oil pump 120 to the advancing angle chamber R1 via the resultant change-over valve 100 and the advancing angle chamber 11. Further, the oil is drained from the delaying angle chamber R2 to the reservoir 130. Then, the rotational shaft side members such as the cam shaft 10, the inner rotor 30 and the vanes 50, are rotated relative to the rotational transmitting member such as the outer rotor 40 and the timing pulley 70 in the clockwise direction in FIG. 5, resulting in the furthest advancing angle condition as shown in FIG. 6 under which the volume of the delaying angle chamber R2 is minimized. It is to be noted that under the resultant condition as shown in FIG. 6, the receiving bore 32 is isolated from the retracting bore 46, which leads to a leakage of the oil from the retracting bore 46 through a gap between the inner rotor 40 and the outer rotor 40. Thus, the locking piston 60 which is urged by the spring 61 is brought into sliding contact onto an outer surface of the inner rotor 40.

If the first change-over valve 100 is switched to the delaying angle position while the variable valve timing device is in the furthest advancing angle condition as shown in FIG. 6, the oil is supplied to the delaying angle chamber R2 from the oil reservoir 120 via the resultant change-over valve 100 and the delaying angle passage 12. The oil in the advancing angle chamber R1 is drained therefrom to the reservoir 130. Then, the rotational side members such as the cam shaft 10, the inner rotor 30 and the vanes 50 are rotated relative to the rotational transmitting members such as the outer rotor 40 and the timing pulley 70, in the counter-clockwise direction in FIG. 6, whereby the furthest delaying angle condition as shown in FIG. 5 is established. It is to be noted that, during the transfer from the furthest advancing angle condition shown in FIG. 6 to the furthest delaying angle condition shown in FIG. 5, the receiving bore 32 comes into fluid communication with the retracting bore 46 from the isolated condition therefrom, and thus the oil supplied to the receiving bore 32 after passing through the pilot passage 13 begins to urge the locking pin 60 in the outward direction against the biasing force of the spring 61. This means that the locking pin 60 is made to be held in the retracting bore 46, resulting in that the locking pin 60 is out of contact with the outer surface of the inner rotor 30.

In the foregoing structure, the oil supply to and the oil drain from the pilot passage 13 are established by the second change-over valve 110 independent of the oil supply from the oil pump 120 to one of the advancing angle passage 11 and the delaying angle passage 12, and the concurrent oil drain to the reservoir 13 from the other of the advancing angle passage 11 and the delaying angle passage 12. Thus, for example, whenever the internal combustion engine is in operation or rotational which ranges from its initiation to termination except for a time duration immediately after the initiation in which the rotational is unstable, the oil can be supplied in a stable and continual manner to the receiving bore 32 via the pilot passage 13, during the time period subsequent to the initiation of the internal combustion engine and upon termination thereof, the oil can be drained from the receiving bore 32 to the reservoir 130.

Thus, while the internal combustion is in rotational except for the foregoing time period subsequent to the initiation of the internal combustion engine, the head portion of the locking pin 60 can retract into the retracting bore 46 after leaving the receiving bore 32 and locking pin 64 can remain in the unlocked condition. In addition, during the time subsequent to the initiation of the internal combustion engine and upon termination thereof, the head portion of the locking pin 60 is inserted into the receiving bore 32 for maintaining the locking condition. In view of the above, allowing the releasing and locking operations only at the expiration of a predetermined time period immediately after the initiation of the engine and when the engine terminates, respectively, greatly reduces the frequency of the inserting and retracting movements of the locking pin 60 with the receiving bore 32, thereby ensuring smooth and reliable locking and unlocking operations by the locking pin 60 and its related elements.

As an alternative, the connecting port 111 may be connected directly to the connecting port 112 by omitting the second change-over valve 110. In such a connection, it is effective to set the position of the receiving bore 32 so as to receive the locking pin 60 when the volume of the delaying angle chamber R2 is maximized, or when the variable valve timing device reaches the furthest delaying angle condition. In detail, while the internal combustion engine is in rotational, the vane 50 is urged toward the delaying angle direction by a force which is transmitted along the crank shaft (not shown), the timing pulley 70, the outer rotor 40, the vanes 50, the inner rotor 30 and the cam shaft 10 arranged in this order. On the other hand, after termination of the internal combustion engine's operation, with passing of time, the pressure of the oil in each of the advancing angle chamber R1 and the delaying angle chamber R2 drops. Under this resulting condition, when the internal combustion engine is started or initiated, because of an insufficient supply of the oil under pressure to each of the advancing angle chamber R1 and the delaying angle chamber R2, noise may be generated upon collision of the vane 50 to the outer rotor 40. However, such noise generation is prevented by the locking pin 60. The reason is that the locking pin 60 restricts the relative rotational between the inner rotor 30 and the outer rotor 40 until the end of a predetermined time period which is subsequent to the initiation of the internal combustion engine in order to establish a sufficient oil supply to each of the advancing angle chamber R1 and the delaying angle chamber R2. In the foregoing structure, after that time period expires, the second change-over valve 120 supplies oil the from the oil pump 120 to the pilot passage 13 by establishing the fluid communication between the connecting ports 111 and 112. In light of this fact, during the time period immediately after initiation of the internal combustion engine, the oil pump 120 provides little oil pressure, even though a direct supply of the oil from the oil pump 120 to the pilot passage 13 fails to cause any trouble or problem. Thus, the direct connection between the connecting ports 111 and 112 is possible by abolishing the second change-over valve 110.

Figure 7:
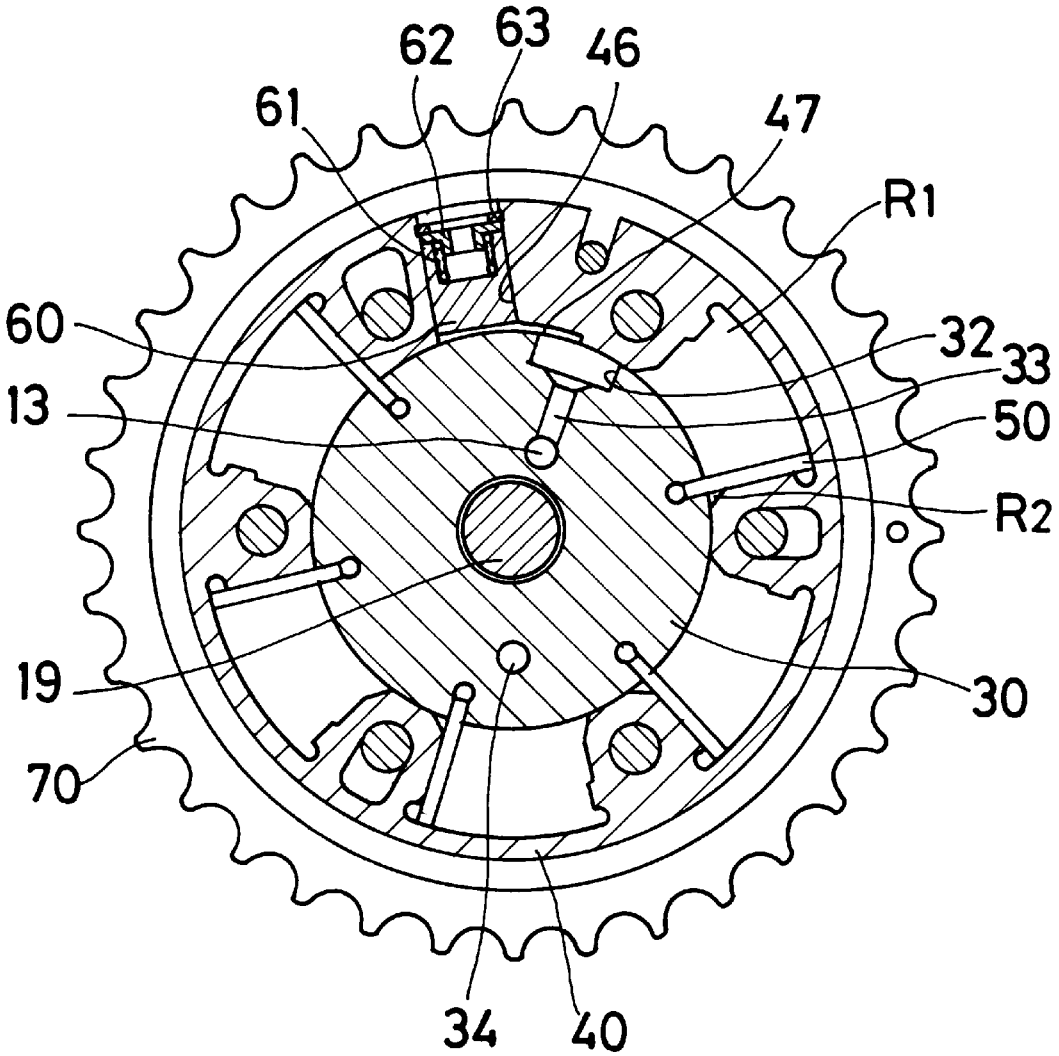
FIG. 7 show a condition according to a second embodiment of the present invention which corresponds to that shown in FIG. 1.

Referring to FIG. 7, a second embodiment of a variable valve timing device according to the present invention is depicted. In this structure, a groove 47 is formed in the inner surface of the outer rotor 40 so as to extend in the circumferential direction. The passage 47 establishes a continual fluid communication between the inner opening of the retracting bore 46 and the receiving bore 32. Thus, regardless of the relative phase angle between the rotational side members such as the cam shaft 10, the inner rotor 30 and the vanes 50 and the rotational transmitting members such as outer rotor 40 and the timing pulley 70, the groove 47 enables a continuous oil supply from the receiving bore 32 to the retracting bore 46, thereby maintaining the locking pin

60 in the retracting bore 46. Thus, it is possible to avoid unnecessary movement of the locking pin 60 such as the sliding contact at its head portion with the outer surface of the inner rotor 30 under rotational after the retraction of the head portion of the locking pin 60 from the retracting bore 46. Also, no noise generation occurs due to an abutment of the head portion of the locking pin 60 onto the outer surface of the inner rotor 30.

Instead of the foregoing structure wherein the vanes 50 are provided in the inner rotor 30 and a set of the locking pin 60 and the spring 61 are provided in the outer rotor 40, the vanes 50 can be provided in the outer rotor 40 and the set of the locking pin 60 and the spring 61 can be provided in the inner rotor 30.

The invention has thus been shown and described with reference to a specific embodiment, however, it should be noted that the invention is in no way limited to the details of the illustrated structures but changes and modifications may be made without departing from the scope of the appended claims.

What is claimed is:

1. A variable valve timing device comprising:

a rotational shaft for opening and closing a valve;

a rotational transmitting member rotatably mounted on the rotational shaft;

a vane provided to one of the rotational shaft and the rotational transmitting member;

an operating chamber defined between the rotational shaft and the rotational transmitting member and divided into an advancing angle space and a delaying angle space by the vane extended into the operating chamber;

a first passage formed in fluid communication with the advance angle space for supplying and discharging a fluid therein and therefrom, respectively;

a second passage formed in fluid communication with the delay angle space for supplying and discharging the fluid therein and therefrom, respectively;

mechanical locking means for locking a relative rotation between the rotational shaft and the rotational transmission member, the mechanical locking means disposed between the rotational shaft and the rotational transmitting member; and a third fluid passage provided independently of the first and the second fluid passages for supplying an oil to the mechanical locking means.

2. A variable valve timing device as set forth in claim 1, wherein the mechanical locking means includes a retracting bore formed in one of the rotational shaft and the rotational transmitting member, a spring-biased locking pin fitted in the retracting bore, and a receiving bore formed in the other of the rotational shaft and the rotational transmitting member, receiving the locking pin when the receiving bore is brought into alignment with the retracting bore due to an in-phase relationship between the rotational shaft and the rotational transmitting member, and supplied with oil from the third fluid passage for urging the locking pin toward the retracting bore.

3. A variable valve timing device as set forth in claim 2, wherein a passage is provided in one of an inner surface of the rotational transmitting member and an outer surface of the rotational shaft in order to establish a continual fluid communication between the retracting bore and the receiving bore.

* * * * *